United States Patent [19]

Kokubo et al.

[11] 4,064,391

[45] Dec. 20, 1977

[54] COUNTING METHOD IN A LEAVES COUNTING MACHINE

[75] Inventors: Eiichi Kokubo, Urawa; Tuyoshi Miyagawa, Chigasaki, both of Japan

[73] Assignee: Laurel Bank Machine Co., Ltd., Tokyo, Japan

[21] Appl. No.: 653,374

[22] Filed: Jan. 28, 1976

[30] Foreign Application Priority Data

Jan. 30, 1975 Japan ..... 50-12810

[51] Int. Cl.[2] ..... G06M 9/02

[52] U.S. Cl. ..... 235/92 SB; 235/92 R; 271/106

[58] Field of Search ..... 235/92 SB, 92 PK, 98 R; 271/95, 96, 106

[56] References Cited

U.S. PATENT DOCUMENTS

| | | | |
|---|---|---|---|
| 3,041,067 | 6/1962 | Fux et al. | 271/96 |
| 3,597,594 | 8/1971 | Evans | 235/92 SB |
| 3,652,081 | 3/1972 | Hatanaka et al. | 271/95 |
| 3,746,841 | 7/1973 | Fenske | 235/92 PK |
| 3,983,367 | 9/1976 | Kondo et al. | 235/92 SB |

*Primary Examiner*—Joseph M. Thesz

*Attorney, Agent, or Firm*—Haseltine, Lake & Waters

[57] ABSTRACT

A leaves counting machine comprising a rotor having a plurality of suction heads arranged on a rotary disc. Leaves are counted by drawing and turning over them one by one by the suction heads in the course of rotation of the rotor. Changes in a suction pressure during the suction of leaves onto the suction heads are detected by a pressure transducer and the counting is executed by the use of pulses detected by the pressure transducer.

2 Claims, 5 Drawing Figures

COUNTING METHOD IN A LEAVES COUNTING MACHINE

This invention relates to a leaves counting machine which counts leaves by drawing and turning over them one by one by suction heads by the use of a suction pressure. It has for its object to provide a counting method in which changes in the suction pressure (suction pressure pulses) as arise when the leaves are drawn and turned over one by one by the suction heads are exploited, the pressure changes exceeding a certain prescribed level are detected by a pressure transducer and delivered as outputs after the transduction into electric pulses, and the number of pulses is counted, whereby the count of the leaves by the suction and turning-over is acquired, the counting method being basically different from a hitherto known method in which iron pieces equal in number to suction heads have the number of their passages through a proximity switch counted by the proximity switch. By adopting the counting method of this invention, the enhancement of the counting speed as has heretofore been considered difficult is enabled. In addition, since the leaves are directly counted in such way that the levels of the suction pressure beyond the prescribed value, i.e., the changes in the suction pressure (suction pressure pulses) themselves at the drawing and turning-over of the leaves are converted into the electric signals by the use of the pressure transducer, the counting precision can be made very high.

In a known leaves counting machine of this type, it is common practice that the plurality of suction heads are arranged at equal intervals at the periphery of a rotary drum, that the iron pieces are provided in correspondence with the suction heads, that the proximity switch 6 is fixed in opposition to the iron pieces, that when the iron piece passes through the position of the proximity switch, an output signal is generated by the proximity switch, that the number of such signals is counted by a counter circuit, and that the number of the leaves is indicated.

The counting is conducted in such manner that the bundled leaves loaded are drawn and turned over one by one by the suction heads. In the conventional machine, when the last leaf, such as bank note, loaded has been drawn and turned over, the atmospheric air immediately flows in from a suction port and the previous vacuum state is released because no leaf opposes to and contacts with the suction head. In attendance thereon, the operating state of a vacuum switch is released to stop delivering its output, and the operations of a rotary drum driving motor and a vacuum pump are also stopped. Besides, an input gate 16 is closed so as to prevent the input signal from the proximity switch from being received.

With this measure, as soon as the last leaf has been turned over, the atmospheric air enters from the suction port to release the previous vacuum state, and in association therewith, the operating state of the vacuum switch is released to issue the output signal. Since, however, the suction head (iron piece) succeeding to the suction head (iron piece) which has lastly drawn the leaf is also rotated at a high speed within a period of time before the issue of the signal, it often passes through the proximity switch due to inertia of the rotation. Such passage through the proximity switch is equivalent to the condition in which the suction head has drawn and turned over the leaf, so that an output signal is provided from the proximity switch. This often results in an overcount which is larger than the number of the leaves having been actually drawn by suction. Since the known machine counts the number of the passages of the iron pieces disposed in correspondence with the suction heads, such miscount has been deemed an inevitable disadvantage which is technically extremely difficult to solve. In view of the purpose for counting the bank notes, however, the counting precision is requested to be very high, and the improvement has been desired more intensely than before in spite of the extreme difficulty. Further, although it has considerably eagerly been requested to render the counting speed of such prior-art machine high, the enhancement of the speed beyond a certain limit has been hard to desire because of the disadvantage of the miscount due to inertia as stated above.

According to this invention, even in the case explained above, the suction heads reliably draw the leaves, and the number of the changes in the suction pressure (suction pressure pulses) at the time when the leaves are turned over is directly counted and converted into the number of leaves taken off, so that the reliability of the counting is extraordinarily high. Besides, the enhancement of the counting speed as has heretofore been deemed difficult becomes possible. Therefore, the counting method of this invention can be said to be the most excellent when applied to the leaves counting machine.

This invention will be described in detail in connection with an embodiment illustrated in the accompanying drawings.

Figure 1:
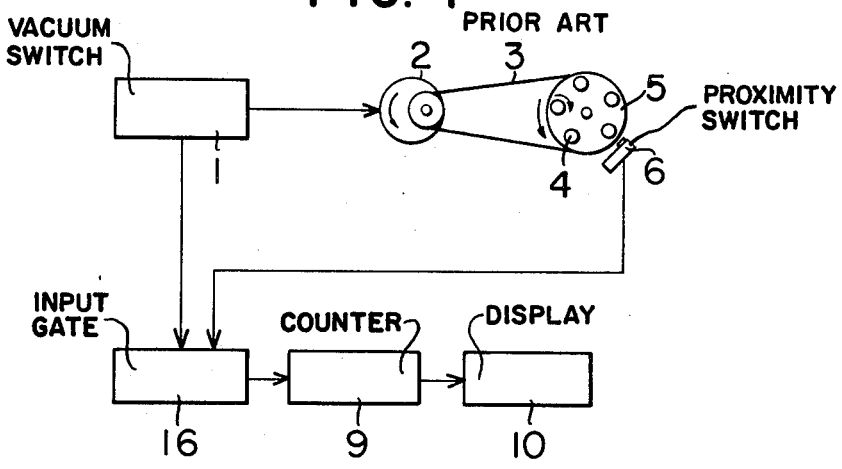
FIG. 1 is a block diagram of a known leaves counting machine.
Figure 2:
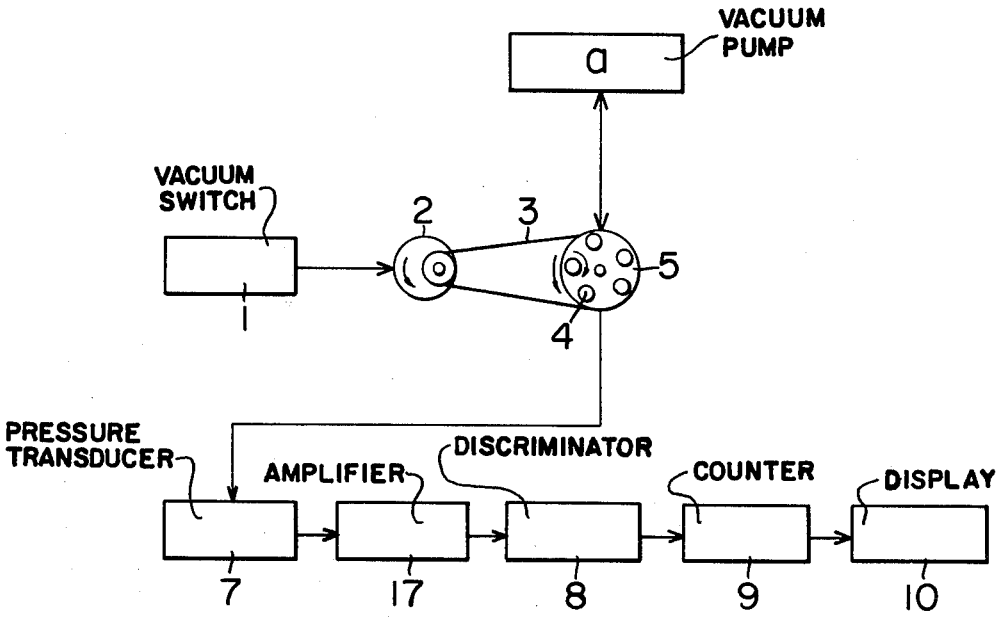
FIG. 2 is a block diagram of this invention.
Figure 3:
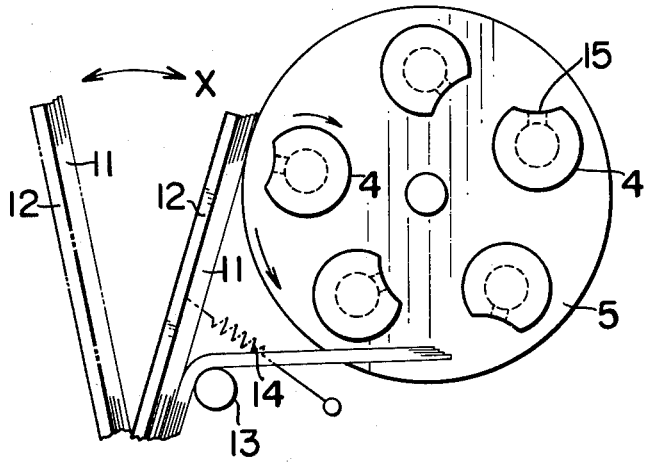
FIG. 3 is a view of the state of suction by a suction head.
Figure 4:
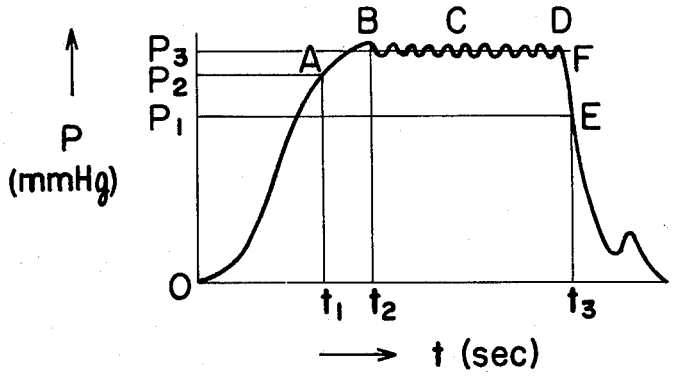
FIG. 4 is a diagram of a pressure variation by a pressure transducer.

Referring to FIG. 2, a plurality of suction heads 4 are disposed on the circumference of a rotary drum 5 which is driven through a belt 3 by rotation of a motor 2. The respective suction heads 4 revolve around the axis of the rotary drum 5 while revolving on their own axes as indicated by arrows, and they draw and separate leaves from a bundle of leaves 11 (FIG. 3) one by one by a suction pressure. Changes in the suction pressure at the time when the leaves are drawn are directly detected by a pressure transducer 7, and pulses thus detected are counted. More specifically, when the bundle of leaves 11 is loaded on a holder 12 (FIG. 3) and a start button, not shown, is depressed, a vacuum pump *a* starts rotation. A suction port 15 (FIG. 3) of the suction head 4 at a suction position communicates with the vacuum pump *a* through a communicating pipe, not shown, to initiate suction. A vacuum switch 1 which is disposed at one end of the communicating pipe and the pressure transducer 7 assumes a stand-by state. The holder 12 is pulled by a spring 14 (FIG. 3) so that, when it moves as indicated by arrows X and stops at a predetermined position with the leaves held between it and a keeper rod 13 (FIG. 3), a part of the foremost leaf may come into contact with the suction head 4. In such state, the leaf contacts the suction port 15 of the suction head 4 and covers it. As soon as the suction pressure exceeds a prescribed value, the vacuum switch 1 is actuated to provide an output signal, and the rotation of the motor 2 is initiated by the signal. With the rotation of the motor, the suction heads 4 draw and separate the leaves one by one while revolving on their own axes and around the axis of the rotary drum. Changes in the suction pressure (suction pressure pulses) at the time when the leaves are drawn are directly detected by the pressure transducer 7, and the detected pulses are converted into electric pulses. In this way, the leaves are successively counted. Hereunder, the state of the suction pressure detected by the pressure transducer 7 will be explained with reference to FIG. 4.

When the vacuum pump *a* rotates to draw the leaf by the suction head 4, the suction pressure rises gradually. At a time $t_1$ (sec.), the suction pressure $P_2$ (mmHg) lies at a point A, the vacuum switch 1 is actuated, the motor 2 is rotated by the signal of the switch, and the operation of drawing and turning over the leaves one by one is started. A point B at $t_2$ (sec.) is a point at which the first leaf is drawn by suction. C corresponds to the suction pressure pulses which are being counted. Further, it is at D that the counting has been terminated, and it is at F that after the last leaf has been drawn and turned over, the atmospheric pressure has entered from the suction port 15 to start lowering the suction pressure. At an intermediate point E at $t_3$ (sec.) at which the suction pressure has lowered to $P_1$ (mmHg), the operation of the vacuum switch 1 is released and the motor 2 as well as the vacuum pump *a* is stopped by the signal thereof.

Figure 5:
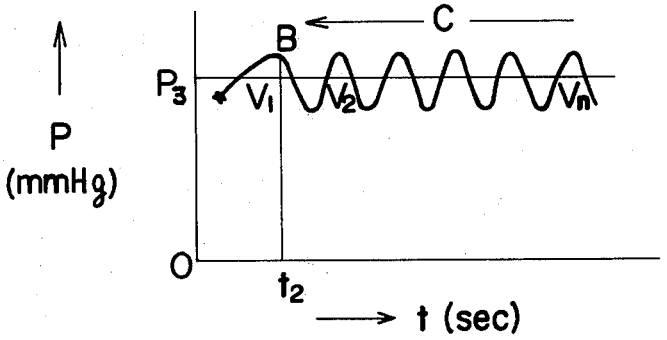
FIG. 5 is an enlarged view of suction pressure pulses in the course of counting as are shown in FIG. 4.

FIG. 5 is an expanded view of the suction pressure pulses C which are being counted. The suction pressure pulses $V_1, V_2 \ldots V_n$ in the range C are amplified by an amplifier 17 (FIG. 2), outputs of which are discriminated by a level discriminator circuit 8 (FIG. 2). Assuming that the suction pressure pulse at the time when the leaf has been drawn by suction corresponds to the suction pressure of at least $P_3$ (mmHg), naturally the suction pressure does not reach the value $P_3$ (mmHg) in case where the suction head has failed to draw the leaf, and hence, the discrimination can be clearly carried out. The suction pressure pulses whose suction pressures are at least $P_3$ (mmHg) are provided from the level discriminator circuit 8. The output pulses are subsequently delivered as inputs to a counter circuit 9 (FIG. 2) and counted therein. The result is indicated by a display circuit 10 (FIG. 2).

As set forth above, this invention expresses the suction pressure and its variation by the use of the pulses, so that the counting is very clear and quick. Moreover, the pulses are caught after being amplified and expanded by the amplifier, so that any change can be precisely grasped. Accordingly, the counting by the turning-over of the leaves can be executed reliably and promptly beyond comparison with the prior-art one, and it may safely be said that there is not any fear of the miscount due to inertia as previously stated. Although, in the explanation of the present embodiment, the system in which the leaves are drawn by suction by rotating the plurality of suction heads has been referred to, it is to be understood that the counting method according to this invention is applicable to all systems in which the leaves are drawn and turned over and then taken out by employing the vacuum pressure.

Since this invention is constructed as described above, it resides in the system which, does not indirectly count the leaves as in the prior art but which directly counts the leaves taken off. The invention therefore provides the counting system of great practical value which can raise the counting precision and which can also realize the enhancement of the counting speed has hitherto been deemed difficult.

We claim:

1. A counting method in a leaves counting machine wherein a rotor has a plurality of suction heads arranged on a rotary disc at equal intervals and wherein leaves are counted by drawing and turning the leaves over one by one by the suction heads in the course of rotation of the rotor, said method comprising detecting changes in suction pressure during the suction of the leaves against the suction heads by a pressure transducer, converting the change in suction pressure into an electrical pulse by said transducer, feeding the pulses from the transducer through an amplifier and a level discriminator circuit and counting said pulses.

2. A method as claimed in claim 1 wherein said leaves are held in a pivotable mount adjacent the path of travel of the suction heads, the method further comprising elastically biassing said mount so that the leaves are urged to a position such that when a suction head faces the leaves it pulls the foremost leaf therewith.

* * * * *